United States Patent [19]

Rumble et al.

[11] 4,014,437

[45] Mar. 29, 1977

[54] DISPLAY UNITS MORE PARTICULARLY FOR CASSETTES, TAPE CARTRIDGES AND THE LIKE

[76] Inventors: Clive St. John Rumble; Richard Roy Rumble, both of 47 Orchard Court, Portman Square, London W.1., England; Patrick Joseph Henderson, Coastguard Road, Larne, Ireland

[22] Filed: Aug. 27, 1975

[21] Appl. No.: 608,385

[30] Foreign Application Priority Data

Aug. 30, 1974 United Kingdom ..... 38032/74

[52] U.S. Cl. ..... 211/4; 211/78; 211/131; 211/166

[51] Int. Cl.² ..... E05B 73/00; A47F 5/02

[58] Field of Search ..... 108/94, 95, 141, 147; 211/4, 70, 77, 78, 95, 115, 129, 131, 144, 163, 166; 40/68, 78, 104.19, 106; 194/39, 40, 49, 2, 83–85, 88, 91; 206/45.15, 387; 312/215, 216, 222; 248/415–418, 296, 145

[56] References Cited

UNITED STATES PATENTS

| | | | |
|---|---|---|---|
| 380,473 | 4/1888 | Austin | 211/4 X |
| 1,848,183 | 3/1932 | Madsen | 248/417 |
| 2,702,075 | 2/1955 | Richards | 248/418 X |
| 2,978,285 | 4/1961 | Jester | 211/131 X |
| 3,158,264 | 11/1964 | Bittner | 211/166 X |
| 3,169,496 | 2/1965 | Muggli et al. | 108/94 |
| 3,674,156 | 7/1972 | Krebs | 211/4 |
| 3,802,656 | 4/1974 | Virblas | 248/417 X |

*Primary Examiner*—James T. McCall
*Assistant Examiner*—Terrell P. Lewis
*Attorney, Agent, or Firm*—Arthur B. Colvin

[57] ABSTRACT

This invention relates to display units for cassettes and like articles.

The display unit comprises a vertical support spindle on which is rotatably mounted a plurality of spaced trays. Display sections are formed by adjacent trays for receiving the cassettes and the cassettes are released by axial movement of the adjacent trays on the support spindle.

According to the invention adjacent trays are rotatable relative to each other to produce the necessary axial movement and locking means is provided along the length of the spindle to prevent unauthorized operation.

9 Claims, 9 Drawing Figures

DISPLAY UNITS MORE PARTICULARLY FOR CASSETTES, TAPE CARTRIDGES AND THE LIKE

This invention relates to units for displaying cassettes, tape cartridges, books, watches, pens, records and the like (hereinafter referred to generally as cassettes) for inspection, for example, by customers in premises such as shops.

Hitherto, cassettes for sale have generally been openly displayed for examination by potential customers on counters or open display units. The present invention has as its main object the provision for an improved display unit, the construction of which enables cassettes to be stored for ready inspection as to their content but which prevents the unauthorised removal of the cassettes from the unit by the customer. A further object is to provide such a display unit which is simple in construction and which provides also a considerable saving in space due to its improved design and method of mounting.

In its broadest aspect the display unit, in accordance with the invention, is primarily intended for location in a vertical position. The unit comprises a central rod or support pillar for mounting on a base member or other structure and which carries a plurality of shelf-like units or trays for supporting the cassettes to be displayed. The trays are normally spaced apart a distance for accommodating the cassettes to be displayed and each tray is formed with a retaining flange or other means for preventing the removal of cassettes therefrom. In a preferred embodiment of the invention adjacent trays are formed with co-operating cam members whereby relative rotation of the adjacent trays provides an axial movement of at least one of the trays along the rod or support pillar so as to provide a larger gap between the adjacent trays thus permitting the removal of a selected cassette.

In order that the invention may be clearly understood the preferred embodiment will now be described in detail with reference to the accompanying drawings in which.

Figure 1:
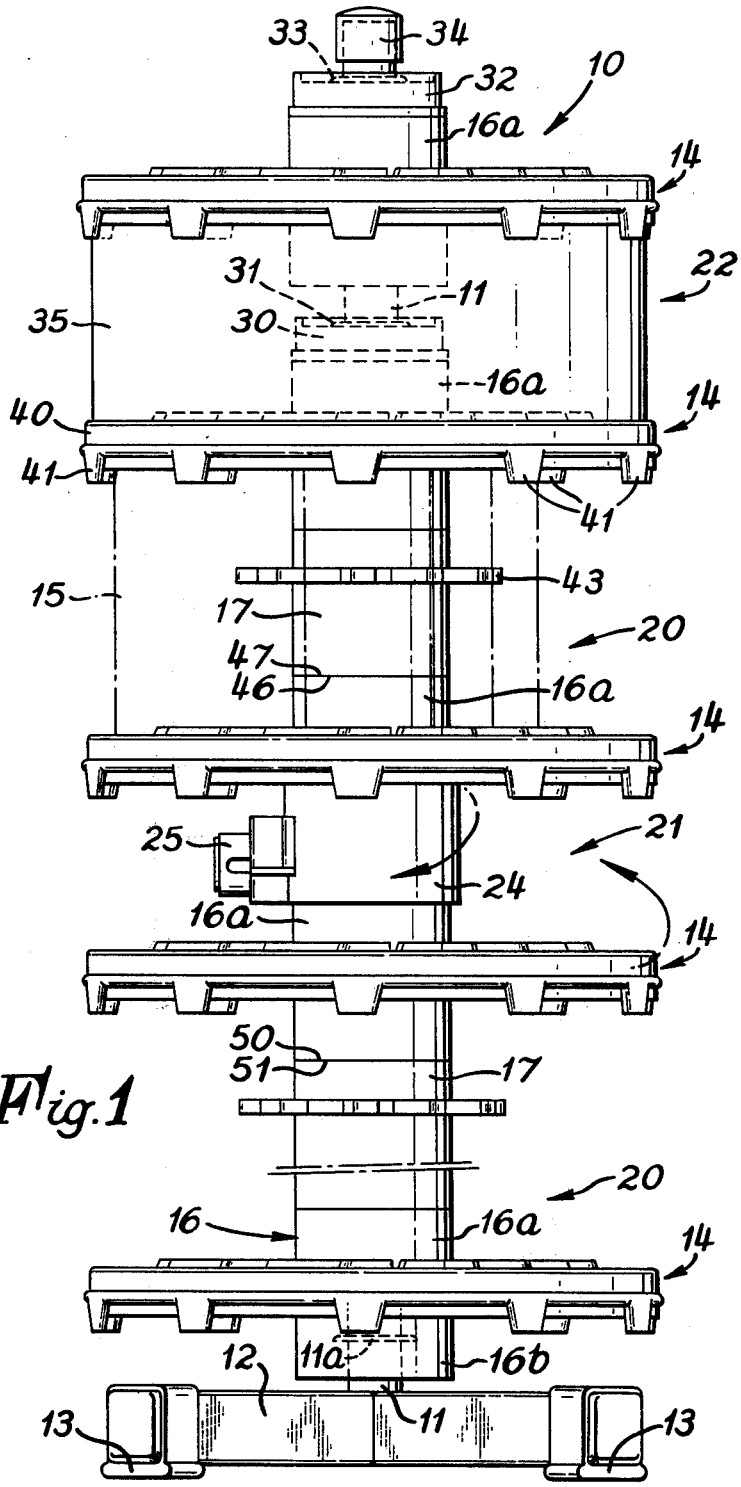
FIG. 1 is a side elevation of the display unit in accordance with the invention with the trays in the locked position.
Figure 2:
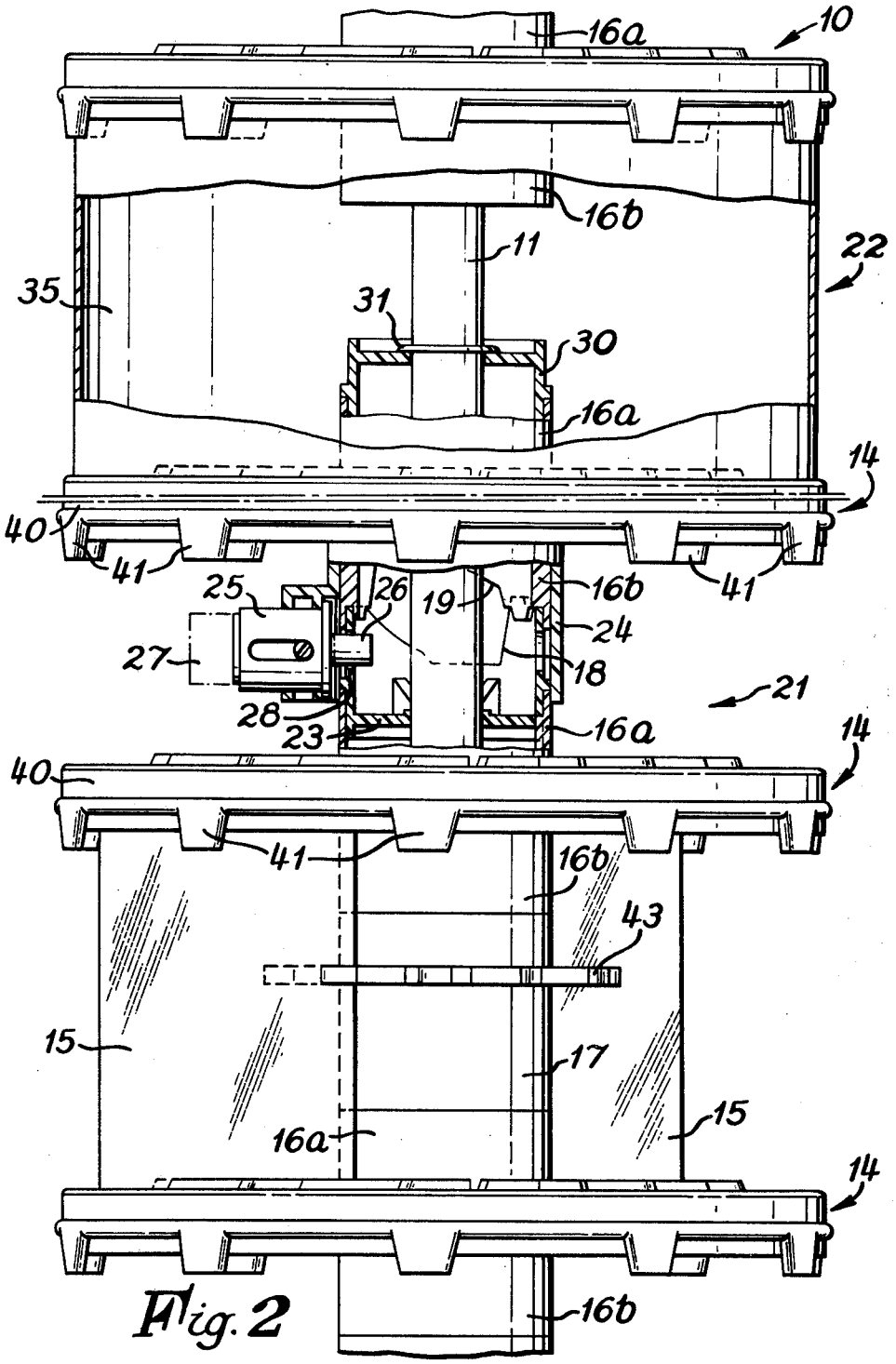
FIG. 2 is a part sectional view on an enlarged scale of the trays adjacent the locking mechanism of the display unit.

Referring now to FIGS. 1 and 2 of the drawings, the display unit 10 comprises a central spindle 11 fixedly mounted on a stand 12 having supporting feet 13. A plurality of shelf-like units or trays 14 are rotatably-mounted on the fixed spindle 11 for displaying cassettes 15 for inspection by potential customers.

Figure 3:
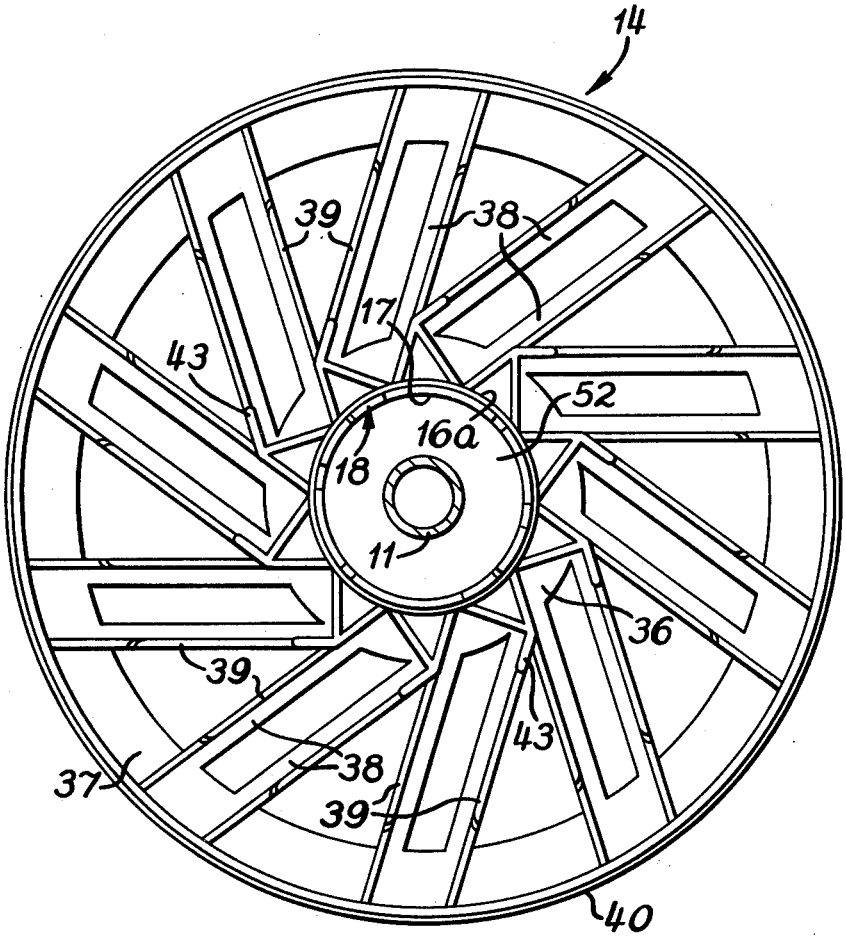
FIG. 3 is a top plan view of one of the trays of the display unit.

Each tray 14 is circular in construction with a central hub section 16 having an upper part **16*a* extending above the tray and a lower part 16*b* extending below the tray. A spacer section 17 is detachably connected to the upper part 16*a* of the hub sections of those trays on which cassettes are to be displayed. The sections 17 are mounted on the central spindle for rotation with the tray to which they are attached and their axial length is determined by the size of the articles to be displayed. In FIG. 3 the spacer section 17 is shown in the top plan view of the tray so as to indicate cam surfaces 18 on the upper edge and which co-operates with similar cam surfaces 19 on the lower edge of the hub section 16*b*** of the next uppermost tray (see FIG. 4). The shape of these cam surfaces and their function will be described hereinafter with reference to FIGS. 5 to 7 of the drawings.

In the assembly of the unit a spring clip (not shown) is fixedly mounted on the lower end of the spindle 11 adjacent to stand 12. A washer 11A is located to engage over the spring clip and this supports the first tray 14 in lower part **16*b* of its hub section. Trays 14 (with spacer sections 17) are then fitted on the central spindle 11 to provide the appropriate number of display sections 20. The unit is completed by a locking section 21, a further display section 20 and finally by an advertising section 22**.

The locking section 21 is shown in greater detail in FIG. 2. In this section of the unit the upper part **16*a* of the hub section of the lower tray 14 is provided with a short spacer section 23 which is fitted within the hub part 16*a* for rotation therewith. The spacer section 23 is provided with cam surface 18 which co-operates, as before, with cam surface 19 on the lower edge of hub part 16*b* of the upper tray 14. An outer sleeve 24 is fixedly mounted around hub part 16*b* and fits over hub part 16*a*. The sleeve 24 carries a barrel-type key-operated lock 25 having an internally projecting spigot 26 engaged by pressing plunger 27 inwardly within an aperture 28 in the wall of spacer section 23. In order to engage spigot 26 in aperture 28 the hub section 16*a* must be angularly positioned correctly relative to sleeve 24 and this is obtained by relative rotation of the trays 14 forming the locking section 21. The arrangement is such that during the rotational movement of the trays, the cam surfaces 18 and 19 move relatively to each other and effect an axial movement of the trays. In the locked position as shown, the trays 14 forming the locking section 20** are spaced apart the maximum distance. Release of the locking mechanism enables the parts to rotate relatively to each other as shown by the arrows in FIG. 1, which by reason of the cam surfaces permit the trays to move axially towards each other thus providing an unlocked condition in which the trays are spaced a minimum distance apart.

The advertising section 22 consists of a lower tray 14 the upper hub section **16*a* of which is fitted with an end cap 30 which in the locked position of the locking section 20 engages a washer 31 on spindle 11 which is fixedly retained by a spring clip. The hub part 16*a* of the upper tray 14 of the advertising section 22 is similarly fitted with an end cap 32 which engages washer 33 in the locked position of the unit, the washer 33 being retained by a spring clip and the spindle 11 being completed by a cover 34. An advertising ring 35 is located between the trays 14 of the advertising section 22. The fixed end washers 11A and 33 provided a datum operating length on spindle 11**.

In the unlocked condition of the unit the reduction in the axial distance between the trays 14 of the locking section 21 provides a similar aixal distance along the length of the spindle 11 between the fixed end washers for relative axial movement between the trays 14 of a selected display section 20. It is only necessary to rotate the trays of the selected display section 20 in opposite directions to obtain an axial movement of the upper tray upwardly away from the lower tray due to the co-operating cam surfaces 18 and 19. This increased spacing of the trays permits the removal of a selected cassette.

Figure 4:
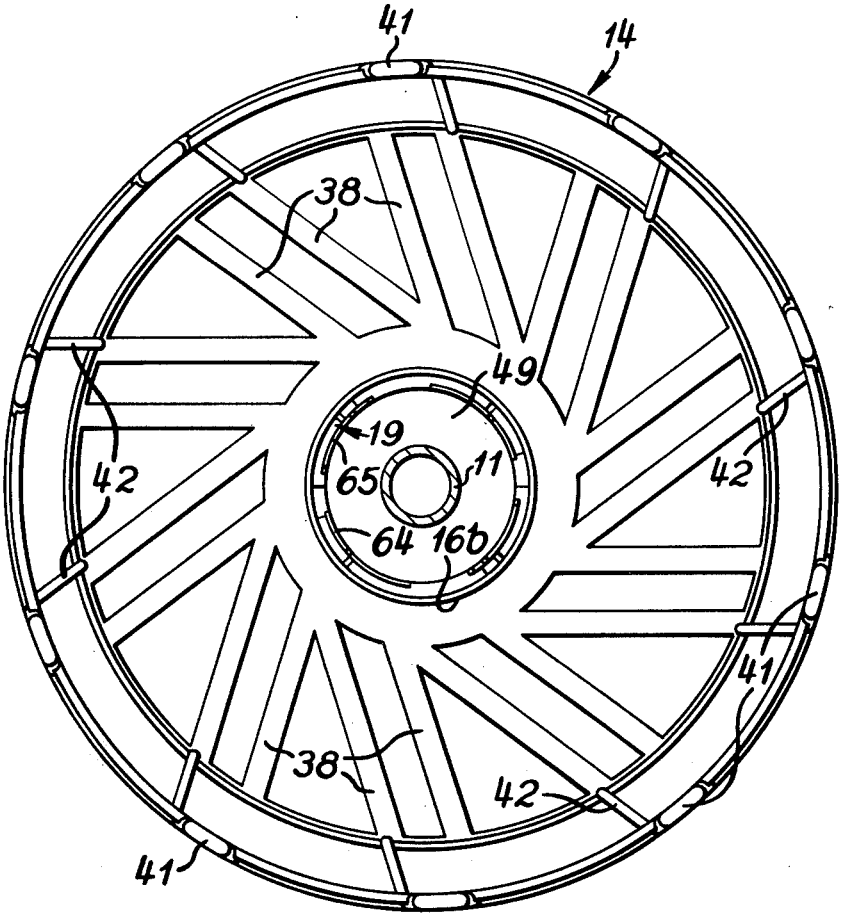
FIG. 4 is an underneath plan view of the tray of FIG. 3.

The cassettes 15 are supported on the upper surface of the trays 14 of each display section 20. Referring to FIG. 3, each tray 14 has an inner ring section 36 surrounding the hub 16 and which is connected with an outer ring 37 by a plurality of flat spokes 38 which may be radially located, but which are preferably aligned as shown, away from the radial direction. The spokes 38 are arranged in parallel pairs and the spokes of each pair have upstanding flanges 39 along their outer edges so as to provide cassette receiving channels. The outer ring 37 is provided with a peripheral rim 40 which extends upwardly to block the outer end of each of the channels and also downwardly to block the outward movement of cassettes from the corresponding channels in the next lowermost display section 20. To ensure such blocking action the rim 40 is provided also with spaced downwardly extending lugs 41 above each channel. As shown in FIG. 4 the underneath of the ring section 37 is also provided with downwardly extending lugs 42 projecting inwardly from the rim 40 parallel to the outer edge of the longer spoke of each pair. The lugs 42 support one side edge of the corresponding cassette which can move in the opposite direction with the lower tray as the trays are contra-rotated. The cassettes 15 are supported along their inner edges by angled arms 43 extending from the spacer member 17.

Figure 5:
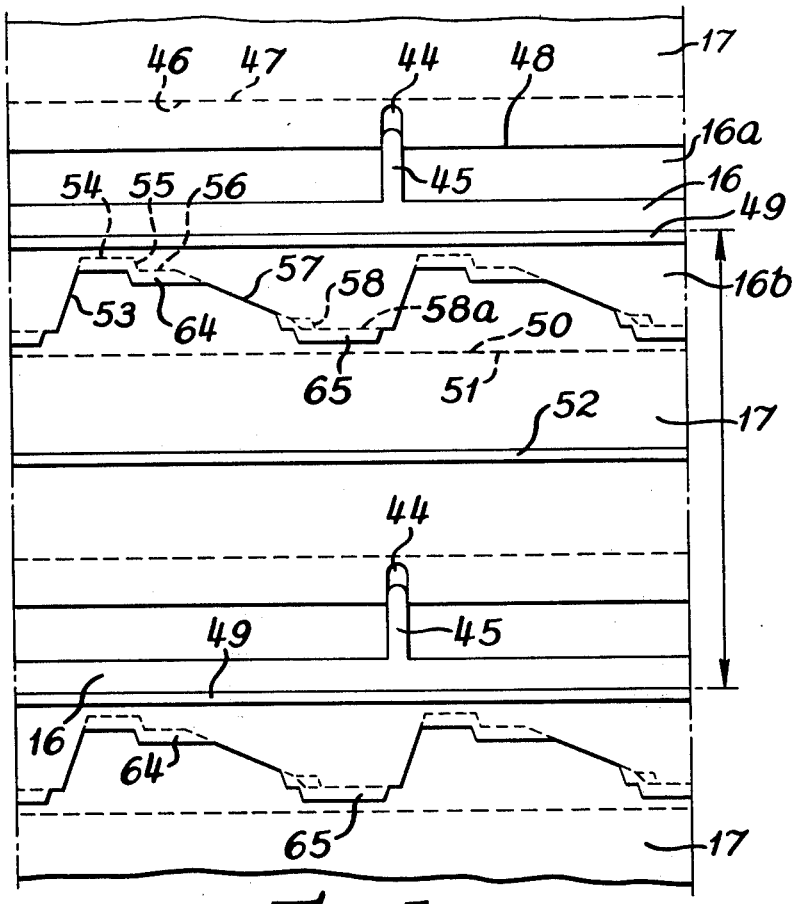
FIG. 5 is a development view from inside the hub sections of two adjacent trays showing the interengagement of the cam surfaces on the hub sections with the corresponding cam surfaces on the spacer section mounted on the adjacent lower tray.
Figure 6:
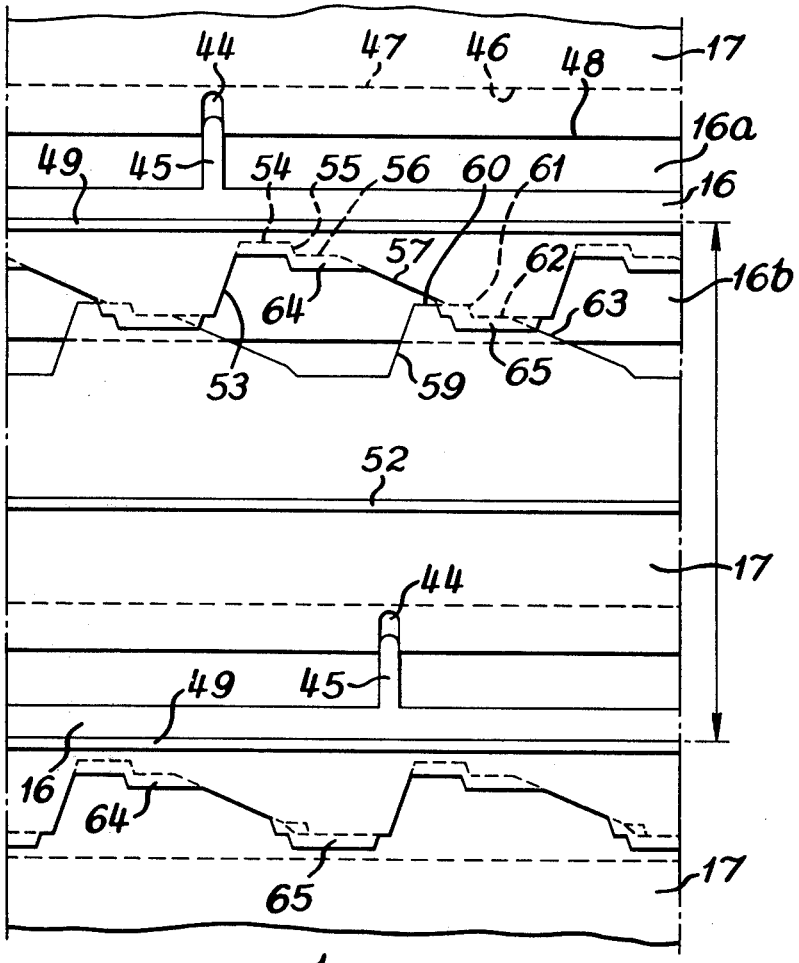
FIG. 6 is a view similar to FIG. 5 but showing the adjacent trays moved to a spaced position to allow removal of a selected cassette carried by the lower tray.

FIGS. 5 and 6 of the drawings are inside views of the hub sections 16 of a pair of trays 14 forming a display section 20 together with the intermediate and adjacent spacer sections 17. The upper spacer section 17 engages within the upper section **16*a* of the hub section 16 and has a slot 44 which is engaged by an axial projection 45 on the inside surface of hub section 16*a* to prevent relative rotation of the parts. The upper edge 46 of the hub section 16*a* engages a shoulder 47 on the outer surface of spacer section 17 and the lower edge of spacer section 17 is shown at 48**.

The hub section 16 has an inside ring 49 provided with an aperture for spindle 11.

The lower hub section **16*b* has its lower edge 50 engaging a shoulder 51 on the outer surface of the next lower spacer section 17 which has an inside ring 52 provided with an aperture for spindle 11. The inside surface of the hub section 16*b* is formed with cam surface 19 which comprises an inclined stop section 53 followed by a straight dwell section 54, a short inclined stop section 55, a straight dwell section 56, an inclined section 57 and a stop section 58. The co-operating cam surface 18 on the upper edge of spacer section 17 corresponds to cam surface 19 and comprises an inclined section 59 abutting inclined stop section 53 in the closed position of the display section 20 as shown in FIG. 5, followed by surface 60 engaging surface 54, inclined surface 61 engaging stop surface 55, surface 62 engaging surface 56 and surface 63 engaging surface 57. FIG. 6 shows the relative position of the cam surfaces as the top hub 16 is moved angularly relative to the spacer member 17 of the lower hub 16. As the parts rotate, surface 61 rides over and out of the inclined stop surface 55. This causes the hubs to move axially apart and the movement continues as surface 63 slides down surface 57 and until surface 61 engages stop surface 58, in which position surface 62 engages below surface 58A to hold the parts axially spaced. The axial distance between the hub section of the trays in each position is shown by the arrows. In the reverse direction of movement surface 63 slides up surface 57 until surface 60 engages with surface 54 and the surface 59 abuts stop surface 53. As shown the hub section 16*b* is provided with a retaining overlap or guard 64 over surfaces 54, 55 and 56 and a further overlap or guard 65 over stop surface 58 (see also FIG. 4). The guards 64 and 65 retain surface 60 of cam 18 in position to prevent jumping out of surface 60** due to forced rotation of the parts especially in the locked position.

Figure 7C:
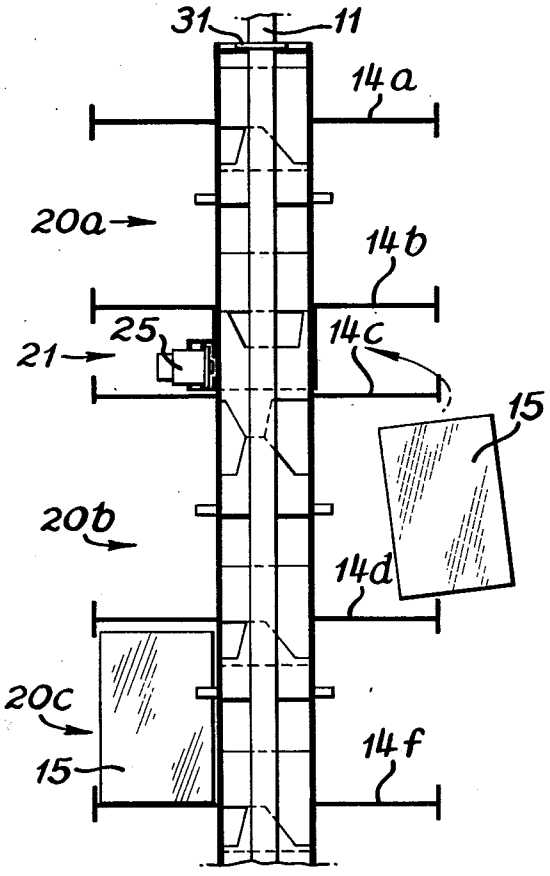
FIGS. 7A to 7C show diagrammatically the sequence of operations to unlock the display unit to allow the removal of a cassette from a particular tray.
Figure 7B:
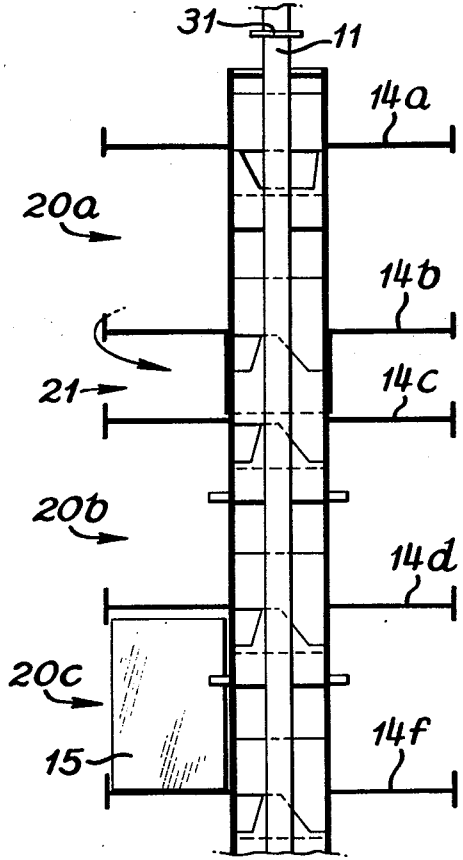
Figure 7A:
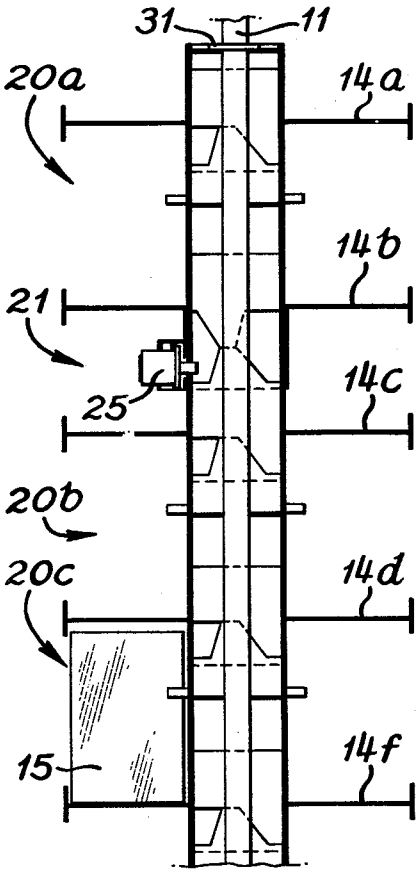

FIGS. 7A to 7C are diagrammatic views of a display unit showing the sequence of operations to release a selected cassette.

In FIG. 7A the locking mechanism 25 is engaged in the locking section 21 to maintain the trays **14*b* and 14*c* spaced apart their maximum distance so that the stack of trays occupies the effective length of spindle 11 between the fixed washers thus preventing any relative axial displacement of the trays to release cassettes. It will be noted that the cam surfaces 18 and 19 in locking section 21 are in position of FIG. 6**.

In FIG. 7B the locking mechanism has been released thus allowing tray **14*b* to rotate relatively to tray 14*c* until the cam surfaces are in the position of FIG. 5. In this position the tray 14*b* has been moved downwardly together with the tray 14*a***.

FIG. 7C shows the removal of a selected cassette 15 from display section **20*b* by rotation of tray 14*c* relatively to tray 14*d*. The relative movement of the co-operating cam surfaces produces a relative axial movement resulting in a movement of tray 14*c* upwardly on the spindle 11 together with the trays 14*b* and 14*a*. In this condition the cassettes on tray 14*d* are now positioned between adjacent lugs 41 on tray 14*c*** so that the selected cassette can be removed.

The locking section 21 can of course be located at any position along the display unit while the advertising section can be omitted.

If desired the trays 14 need not be provided with the lower extension of the rim 40 as the design of the lugs 41 will provide the blocking action necessary. Alternatively, the rim may extend downwardly an amount similar to that of the lugs 41 and slots may be provided at the appropriate release points for the cassettes.

The display unit of the invention provides for easy and simple operation of the parts to space a desired display section. Little effort is required to lift the trays axially even from the bottom display section so that units of considerable size can be provided. The cam surfaces are designed to hold the trays of a selected display section apart thus allowing the operator to release the parts before removing the cassette.

We claim:

1. A display unit for cassettes and the like comprising a base, a spindle extending vertically from said base, a plurality of vertically stacked trays rotatably and axially movably mounted on said spindle, adjacent said trays cooperating to provide outwardly open receiver chambers for supporting cassettes, vertically directed flange means on said trays for blocking outward movement of said cassettes from said chambers in said stacked position of said trays, upper and lower fixed stop means on said spindle adjacent the uppermost and lowermost of said stacked trays, respectively, for preventing spreading movement of said trays from said stacked condition, and spacer cam assembly means interposed between at least one adjacent pair of said trays, said cam assembly means including two relatively rotatable hub sections, said cam assembly means being shiftable between an axially elongated locking position at a first relatively rotated position of said hub sections, and an axially foreshortened releasing position at a second relatively rotated position of said hub sections, and releasible locking means on said unit for selectively locking said sections against or releasing said sections for relative rotation to said second position.

2. Apparatus in accordance with claim 1 wherein said releasible locking means is movably mounted between adjacent said hub sections, said locking means selectively locking said sections against and releasing said sections for relative rotation in the locked and unlocked positions, respectively.

3. Apparatus in accordance with claim 2 wherein said hub sections comprising said cam means are mounted on adjacent said trays.

4. Apparatus in accordance with claim 2 wherein said hub sections comprising said cam means define a spacer section mounted on said spindle.

5. Apparatus in accordance with claim 2 wherein said locking means comprises a spigot on one said hub section and an aperture on the other said hub section.

6. Apparatus in accordance with claim 2 wherein said trays include outwardly extending channels leading to said flange means.

7. Apparatus in accordance with claim 1 wherein said cam assembly means includes a dwell portion for maintaining said sections at said second relatively rotated position.

8. A display unit for cassettes and the like comprising a base, a spindle extending vertically from said base, a plurality of vertically stacked trays rotatably and axially movably mounted on said spindle, adjacent said trays cooperating to provide outwardly open receiver chambers for supporting cassettes, vertically directed flange means on said trays for blocking outward movement of said cassettes from said chambers in said stacked position of said trays, spacer cam assembly means interposed between adjacent said trays, said cam assembly means including two relatively rotatable hub sections, said cam assembly means being shiftable between a first relatively rotated locked position of said hub sections wherein said trays are spaced a first axial distance from each other, and a second relatively rotated releasing position of said hub sections wherein said trays are spaced a second and greater axial distance from each other, the combination including locking means for selectively locking said sections against or releasing said sections for axial movement relative to said spindle.

9. Apparatus in accordance with claim 8 and including upper and lower fixed stop means on said spindle adjacent the uppermost and lowermost of said stacked trays, respectively, for preventing spreading movement of said trays beyond the limits defined by said stop means and wherein said locking means comprises an axially expansible and contractible section mounted on said spindle and interposed between adjacent trays.

* * * * *

UNITED STATES PATENT OFFICE
CERTIFICATE OF CORRECTION

PATENT NO. : 4,014,437
DATED : March 29, 1977
INVENTOR(S) : CLIVE ST. JOHN RUMBLE; RICHARD ROY RUMBLE and PATRICK JOSEPH HENDERSON It is certified that error appears in the above-identified patent and that said Letters Patent are hereby corrected as shown below:

In the printed patent on the first page in the heading after "[76] Inventors: Clive St. John Rumble; Richard Roy Rumble, both of 47 Orchard Court, Portman Square, London, W.1., England; Patrick Joseph Henderson, Coastguard Road, Larne, Ireland"

insert:

-- Assignee: Honey Zilla Rumble, London, England --

Signed and Sealed this nineteenth Day of July 1977

[SEAL]

*Attest:*

RUTH C. MASON
*Attesting Officer*

C. MARSHALL DANN
*Commissioner of Patents and Trademarks*